US005106463A

United States Patent [19]

Genders et al.

[11] Patent Number: 5,106,463

[45] Date of Patent: Apr. 21, 1992

[54] HIGH YIELD METHODS FOR ELECTROCHEMICAL PREPARATION OF CYSTEINE AND ANALOGUES

[75] Inventors: John D. Genders, Lancaster; Norman L. Weinberg, E. Amherst; Duane J. Mazur, Amherst, all of N.Y.

[73] Assignee: The Electrosynthesis Company, Inc., East Amherst, N.Y.

[21] Appl. No.: 232,000

[22] Filed: Aug. 15, 1988

[51] Int. Cl.[5] ..... C25B 3/00; C25B 3/02

[52] U.S. Cl. ..... 204/72; 204/73 R; 204/78

[58] Field of Search ..... 204/73 R, 72, 78

[56] References Cited

U.S. PATENT DOCUMENTS

| | | | |
|---|---|---|---|
| 2,907,703 | 10/1959 | Rambacher | 204/73 |
| 4,072,584 | 2/1978 | Cipris et al. | 204/73 R |
| 4,422,917 | 12/1983 | Hayfield | 204/196 |
| 4,551,274 | 11/1985 | Shen | 204/180.1 |
| 4,705,620 | 11/1987 | Bricker et al. | 204/73 R |

FOREIGN PATENT DOCUMENTS

| | | |
|---|---|---|
| 23450 | of 1958 | Japan . |
| 98685 | 6/1982 | Japan . |

OTHER PUBLICATIONS

Mizuguchi et al., Bulletin of the Tokyo Institute of Technology (1965) 64, pp. 1–6.

Wong et al., Jour. Chinese Chemical Society, 25, 149–151 (1977).

*Primary Examiner*—John Niebling

*Assistant Examiner*—Steven P. Marquis

*Attorney, Agent, or Firm*—Howard M. Ellis

[57] ABSTRACT

Amino acid free bases are prepared electrochemically without production of intermediate acid salts. Amino acids having reducible disulfide linkages and at least one basic nitrogen group are reduced at a high surface area, noncontaminating cathode to provide a current density of at least 50 mA/cm$^2$, product yield of at least 90% and an operating current efficiency of at least 90%.

19 Claims, No Drawings

HIGH YIELD METHODS FOR ELECTROCHEMICAL PREPARATION OF CYSTEINE AND ANALOGUES

BACKGROUND OF THE INVENTION

The present invention relates to improved methods for the direct electrochemical synthesis of cysteine and its sulfhydryl analogues as salt-free amino acids, i.e. bases without production of intermediate acid salts.

Cysteine is a sulfhydryl containing amino acid of increasing importance, used in hair wave formulations, nutritional supplements, and as an intermediate in the syntheses of certain pharmaceuticals. L-cysteine is derived from naturally occuring l-cystine, which is produced by hydrolysis of hair, feathers and other animal products; however, d-cysteine and the racemic optically inactive dl-mixture may also be derived by various methods. Cysteine is known to be unstable in neutral or alkaline media, and is easily oxidized by air to cystine.

Cysteine may be prepared by reduction of cystine, a disulfide, according to the equation:

$$(-S-CH_2CH(NH_2)CO_2H)_2 + 2H^+ + 2e \rightarrow 2\ HSCH_2CH(NH_2)CO_2H$$

This reduction has been conducted chemically with reagents such as Na/liquid $NH_3$, Zn, Al or Sn in aqueous HCl, or solutions of $NaBH_4$ have been employed. However, these methods lead to impure cysteine contaminated with inorganic by-products which are often difficult or costly to separate, and even minute traces of such impurities may be unacceptable for some uses, like nutritional supplements.

Heretofore, electrochemical reduction of cystine to cysteine was usually conducted in aqueous acid solution in which the cystine was dissolved in aqueous HCl or $H_2SO_4$. Rambacher in U.S. Pat. No. 2,907,703 (1959) described the electrochemical reduction of an aqueous suspension of cystine hydrochloride in 2N aqueous HCl solution, using an electrochemical cell containing a cathode of Sn, Cu, Ag, Ni or carbon, in which the anode compartment is separated from the cathode compartment by means of a porous diaphragm. If the cathode is a sheet of Cu or a carbon rod, $SnCl_2$ is added to the catholyte, and if the cathode is of Ag or Ni, metallic Sn is added to the catholyte. Cysteine as the HCl salt is obtained after prolonged electrolysis. Additional steps are necessary to obtain pure cysteine as the free-base of the amino acid. Thus, with Rambacher's method, in order to prepare cysteine free-base electrochemically, it was necessary to first prepare the acid salt.

Likewise, Wong and Wang, *J. Chinese Chem. Soc.*, 25. 149 (1977) have described the electrochemical reduction of cystine in aqueous HCl solution at stainless steel electrodes in an electrochemical cell fitted with an anion-exchange membrane. The purpose of the anion-exchange membrane is to allow anions, such as chloride ion to pass through the membrane to the anode side of the cell but not allow cations, or the starting material or product through. The electrolysis product, after evaporation of the aqueous electrolyte solution, was cysteine as the HCl salt. The free amino acid cysteine was then prepared by dissolving the cysteine HCl in ethanol, carefully adding aqueous $NH_4OH$ solution to pH 6.2, and filtering off and drying the free cysteine. Whereas, the electrochemical step gave a 92% yield of cysteine HCl product, the neutralization step gave only an 80% yield of free cysteine. Cysteine is an expensive product, currently about kg, hence losses of cysteine through precipitation steps or otherwise are costly. The Wong and Wang process is impractical on a longer-term production basis, since under these conditions, stainless steel anodes would soon corrode as $Cl_2$ is evolved at the anode, and moreover $Cl_2$ or HOCl generated thereby would eventually attack and destroy the kind of anion exchange membrane that was used (Asahi Glass Co., Selemion AMV).

Mizuguchi et al, *Bull. Tokyo Inst. Technol.* No. 64, 1-6 (1965) conducted electrolyses of cystine in aqueous acid media (HCl or $H_2SO_4$ and in aqueous alkaline media (NaOH, $Na_2CO_3$ and $NH_4OH$), using a porous porcelain diaphragm in a first electrolysis cell to separate anode and cathode compartments. When the aqueous acid solutions were further electrolyzed in a second electrolysis cell containing an ion-exchange resin diaphragm, deacidification to free cysteine was demonstrated to occur in high yield. In alkaline media, Mizuguchi showed that appreciable losses of cystine and cysteine occurred through the porous porcelain diaphragm. Mizuguchi's results with aqueous $NH_4OH$ solution are particularly pertinent to the present invention. Electrolysis of cystine (12.lg) was conducted at a Pb cathode at a low current density of 25mA/cm$^2$ using 3M $NH_4OH$ (about 10% $NH_4OH$ by weight) with added $(NH_4)_2CO_3$, in a batch cell containing a porous porcelain diaphragm. After prolonged electrolysis the catholyte solution was evaporated to dryness leaving 9.0g of crude product containing 7.0g of cysteine and 2.0g of cystine. According to the authors, Pb was not detected in the product. Mizuguchi et al concluded at page 6 that alkaline electrolysis provides lower yields of pure cysteine or its salts than acidic electrolysis. Based on actual results, Mizuguchi et al had a calculated yield of cysteine of about 58% and a current efficiency of about 12%, with about 25% of the valuable product and/or valuable starting material lost, presumably through the separator into the anode compartment. A low current efficiency of about 12% under these conditions signifies that most of the cathodic current was used wastefully for $H_2$ evolution.

Japanese patent No. 58-23450 to Hasaka, first laid open on June 7, 1962 also discloses a process for the electrochemical reduction of cystine to cysteine in aqueous alkaline solutions of ammonia, ammonium carbonate, ammonium chloride, pyridine HCl or piperidine HCl. Hasaka conducted his reaction with a cathode in the form of a low surface area bidimensional plate. Current density was only 10 to 30 mA/cm$^2$. Like Mizuguchi et al, Hasaka's product yield using alkaline electrolyte was low, ie 75%.

Although the Japanese patent (Hasaka) stresses that low cost metals can now be used with alkaline anolyte which could not be employed with acidic solutions, it has also been discovered that lead cathodes like those of Hasaka are capable of introducing unsafe, toxic levels of lead into the cysteine rendering the product unacceptable particularly as a food grade material for additives, nutritional supplements, an intermediate for synthesis of pharmaceuticals, and other products especially intended for internal as well as external use.

Accordingly there is a need for a more economic, more reliable and efficient method of producing high purity cysteine and its analogues electrochemically from cystine and its corresponding analogues which minimizes losses of costly disulfide feed and sulfhydryl product, does not necessitate additional conductive salts, simplifies the separation of product as the free amino acid from the electrolyte solution, avoids the need for a second deacidification electrolyzer, and provides for a single improved electrolyzer which produces the product at higher current densities, in high yields, current efficiency and conversion.

The present invention provides such improved methods for the electrochemical production of cysteine and its sulfhydryl analogues.

SUMMARY OF THE INVENTION

It is a principal object of the present invention to provide a high yield, economic method for the electrochemical preparation of amino acid free-bases directly without preparing intermediate acid salts which comprises the steps of providing an electrochemical cell having an anode and a high surface area, noncontaminating cathode. A basic nitrogenous electrolyte solution comprising a disulfide compound is introduced into the cell as the catholyte. Product is generated by impressing a voltage across the anode and cathode sufficient to reduce the disulfide compound at the cathode. A high yield of the amino acid free-base is produced upon removal of the basic nitrogenous electrolyte. The concentration of the disulfide compound in the electrolyte and the high surface area of the cathode are sufficient to provide a current density of at least 50 $mA/cm^2$ and a product yield of at least 90%, such product being virtually free of potentially toxic trace metals and other contaminants emanating from the cell electrodes. The amino acid free base materials are characterized as being sufficiently free of contaminants that it is suitable for use as a food grade material or additive, or as a intermediate for synthesis of food grade materials or additives, as well as pharmaceuticals.

It is a further object of the present invention to provide basic nitrogenous electrolytes comprising inter-alia aqueous ammonia, anhydrous liquid ammonia with sufficient concentrations of the disulfide reactant to maintain the desired high product yield of at least 90% without loss of the valuable disulfide reactant. Accordingly, a still further object is to conduct the reaction in an electrochemical cell having a high efficiency divider, and in particular an ion-exchange type membrane for separating the catholyte from the anolyte without loss of reactant.

It is yet a further object of the present invention to conduct the electrochemical reaction at consistently higher current efficiencies of at least 90% with improved high surface area electrodes preferably comprising a carbonaceous material, either amorphous or crystalline types, including amorphous carbons which are only partially graphitized, vitreous or glassy carbons, as well as fluorinated carbons, and especially high surface area three-dimensional carbonaceous cathodes having length, width and also depth.

Methods contemplated herein also include step(s) for purifying the free-base materials with aqueous media, removing any insoluble residue from aqueous mixtures including unreacted disulfide compound, and recovering amino acid free base material by removing the aqueous solvent. This method also allows for recovery of any unreacted disulfide reactant. The present invention also includes the step of converting the amino acid free-base material to a salt of an inorganic acid, if so desired.

These and other features and advantages will become more apparent from the following detailed description of the invention.

DETAILED DESCRIPTION OF THE INVENTION

The methods of the invention are primarily concerned with preparation of amino acids, II, such as in their d-, l-, or dl-forms. The term disulfide analogues includes synthesis electrochemically of cysteine and related compounds containing a reducible disulfide linkage, at least one basic nitrogen group and a carboxylic acid function of the general formula, I:

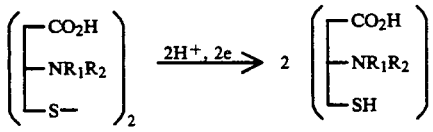

I II where $R_1$ and $R_2$ are H, lower aliphatic ($C_1$ to $C_6$, aryl, aralkyl, or in which $R_1$ and $R_2$ taken together form a nitrogen heterocyclic ring of 3 to 7 atoms in which the nitrogen is basic. Thus, disulfide compounds of structure I may be considered to be alpha, beta, gamma or even omega-amino acids. Examples of disulfide amino acid analogues of structure I include:

$(-SCH_2CH_2CH(NH_2)CO_2H)_2$: homocystine $(H_2NCH_2-\underset{\underset{S-}{|}}{C}HCO_2H)_2$: isocystine $\left(\underset{\underset{S-}{|}}{(CH_3)_2C}CH(NH_2)CO_2H\right)_2$ : penicillamine disulfide $(-SCH_2CH_2NHCH_2CO_2H)_2$ $(-SCH_2-CH(NH_2)CH_2CO_2H)_2$ $(-S-(CH_2)_3-C(CH_3)(NH_2)CO_2H)_2$ $(-S-(CH_2)_2-\underset{\underset{\underset{NR_1R_2}{|}}{(CH_2)_6}}{\underset{|}{C}}HCO_2H)_2$ $(-S-(CH_2)_2-\underset{\underset{\underset{O}{\diagup\diagdown}}{N}}{\underset{|}{C}}HCO_2H)_2$ $(-S-(CH_2)_3-\underset{\underset{\underset{CH_2C_6H_5}{|}}{N-H}}{\underset{|}{C}}HCO_2H)_2$ $[-S-CH_2C(CH(NH_2)CO_2H)_2]_2$

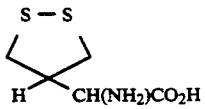

-continued

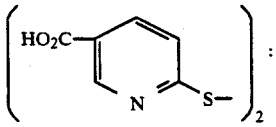

: dithiodinicotonic acid

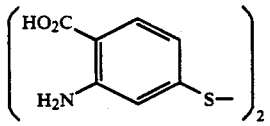

Likewise examples of mercapto amino acids of structure II) include cysteine, homocysteine, isocysteine, penicillamine, 2-mercaptonicotinic acid and 2-amino-3-mercapto-benzoic acid. Other examples of mercapto amino acids will be apparent to persons of ordinary skill in this art from the amino acid analogues disclosed above.

Basic nitrogenous catholytes for the electrochemical production of cysteine and its analogues (II) according to the present invention include aqueous ammonia, anhydrous liquid ammonia and aqueous amine solutions. The amines are lower aliphatic and preferably have boiling points at atmospheric pressure below that of water, but not higher than about 130° C. at atmospheric pressure to facilitate separation from the desired products. An important feature in the selection of the amine nitrogenous-catholyte solution is that upon distillation or evaporation, the amine completely evolves from solution leaving the salt-free disulfide substrate and/or sulfhydryl product, without any or substantially, any racemization or undesirable reaction occuring.

Nitrogenous catholytes may also contain certain volatile organic cosolvents to assist solution of some otherwise insoluble disulfide substrates. These volatile cosolvents may include solvents, such as lower alcohols like methanol, ethanol and isopropanol, as well as acetonitrile, tetrahydrofuran, dioxane and other volatile solvents, or mixtures of nitrogeneous catholytes such as $NH_3$ and $(CH_3)_3N$ in water and/or alcohol. Suitable amines are of general formula, $R_3N$ where the R groups are H, methyl, ethyl, propyl, isopropyl, butyl, isobutyl, sec-butyl or t-butyl or mixtures of alkyl groups. Other amines are also useful like pyrrolidine, isoamylamine, n-amylamine, piperidine, ethylenediamine, and morpholine. Amongst the nitrogenous solutions, aqueous or anhydrous ammonia solutions are preferred because of their high solubilizing ability for substrates and products, low boiling point, good ionic conductivity in combination with dissolved substrates and/or products, ease of separation and low cost. The nitrogenous solution component may be present in the electrolyte in concentrations which partially or totally neutralizes the disulfide, or may be present in slight or even large excess. Thus, the preferable concentrations of the nitrogenous component will be such that its solution with the disulfide reactant results in satisfactory electrolyte conductivity and sufficient solubility of the disulfide which leads to high yields and current efficiencies, at high current density levels, of the mercaptan product.

When aqueous solutions of ammonia are used, ammonia is preferably present in greater than about 5% by weight, more preferably above 10% by weight and optimally above 20% by weight to enable solution of higher concentrations of substrate(I). Even higher effective concentrations of ammonia than the 30% commercially available solution may be prepared by slurrying a saturated mixture of disulfide substrate and 30% aqueous ammonia solution while bubbling in $NH_3$ gas until solution of substrate occurs to the desired concentration. These increased disulfide substrate concentrations permit electrolysis at higher current density, often with lower cell voltage and higher yield and current efficiency of product than heretofore attainable. Distillation or evaporation costs are thereby reduced, for removal of less solvent.

The starting concentration of the disulfide substrate(I) in the nitrogenous catholyte should be greater than about 0.001M and preferably greater than about 0.1M, but most preferably in the range of about 0.2 to 1.0M or more.

While conductive salts, like carbonates and bicarbonates of the nitrogenous component may be added to raise the effective nitrogeneous component concentration, and while these salts are decomposed in the workup steps, these added salts are usually unnecessary and often undesirable since they add additional complexity to the process and cost to the economics.

When an ion-exchange membrane is used as a component of the electrolyzer this should preferably be a cation exchange membrane to minimize transfer and loss of the negatively charged carboxylate anion of the disulfide substrate and/or the product through the membrane into the anode compartment. In membrane separated electrolyzers, the anolyte solution may be a suitably conducting solution which preferably generates protons at the anode on electrolysis. Such anolytes may be various ammonium salts dissolved in aqueous media such as $(NH_4)_2SO_4$, $(NH_4)_3PO_4$, $(NH_4)_2CO_3$, and ammonium salts of organic acids like acetate, formate, oxalate, etc. Other suitable anolytes may be aqueous $H_2SO_4$ or aqueous $H_3PO_4$. While halogen containing anolytes such as aqueous $NH_4Cl$ and aqueous HCl may be used, these are not preferred, since provision must then be made for generation of $Cl_2$ and possible undesirable and dangerous chlorinated nitrogen byproducts such as nitrogen trichloride.

Anodes may be carbonaceous, such as carbon, graphite, vitreous carbon, or specifically fluorinated carbon, graphite or vitreous carbon. Specifically fluorinated carbons are soft fluorinated carbons manufactured and sold by The Electrosynthesis Company, Inc. P.O. Box 430, East Amherst, N. Y. 14051 and are readily available under the trademark "SFC" carbon. SFC materials tend to increase the corrosion stability of these carbons and impart useful catalytic properties. Anodes may also be metallic like Pt on Ti, Pt/Ir on Ti, $PbO_2$ on Pb, $PbO_2$ on Ti, or uncatalyzed or catalyzed ceramic, such as Ebonex® anodes ($Ti_4O_7$) When uncatalyzed by Pt or other noble metals, Ebonex anodes have been found to possess a high overpotential for oxidation of the sulfhydryl products to the corresponding disulfides, compared to oxidation of the nitrogenous electrolyte solution. Although some reoxidation occurs of the product to the disulfide substrate at the anode, use of Ebonex anodes allows removal of the ion-exchange membrane from the electrolyzer design, thereby saving considerable capital and operating costs.

Careful selection of the cathode material is of crucial importance to the high yield reduction of cystine and its disulfide analogues. Conventional metal cathodes comprised particularly of Pb, Hg and their alloys can introduce trace amounts to appreciable quantities of potentially toxic metals into the final product, rendering the product unsuitable for some applications. Generally, for purposes of this invention the expression—noncontaminating cathode—is intended to mean a cathode material which does not introduce potentially toxic substances into the product, but provides product which is food, drug, and cosmetic grade material, wherein the levels of heavy metals and other adulterants present are within the limits set forth by the United States Food, Drug and Cosmetic Act. Thus, for pharmaceutically related products, no toxic heavy metals such as lead are acceptable, whereas for some external uses trace amounts of heavy metals may be permissible, to the extent that their presence does not violate regulatory laws pertaining to adulterants.

High surface area, carbonaceous materials are preferred since the amount of adulterant metals in the final product is usually minimal, or almost non-existent. The most preferred carbonaceous cathode materials are the porous and multidimensional types and include amorphous carbon and graphitic carbons, vitreous carbon, fluorinated carbons, and particularly soft fluorinated materials. Amongst the highest product yields, conversions, and current efficiencies are found at these carbonaceous cathodes, compared to metal cathodes. However, carbonaceous cathodes of high surface area like particulate beds, porous carbons, felts, cloths, or reticulated vitreous carbon (manufactured by ERG Corp., California) provide even better performance. Carbon felts for example, provide near quantitative yield, conversion and current efficiency on electrolysis of cystine in ammonia solution, with passage of the theoretical current. For purposes of this invention, expressions like "carbon felts" "carbon cloth" include both high surface area amorphous carbons, graphitic carbons and amorphous carbons which are partially graphitized. Representative examples of such materials are those available from The Electrosynthesis Company, Inc., East Amherst, N.Y. under the designation GF-S5 and GF-S6 which are ⅛" and ¼" thick materials, respectively. Thin, high surface area porous carbonaceous materials represented by carbon fabrics include fabrics having plain and jersey knit construction. Carbon cloth is also intended to include carbon fiber fabrics. Also included by the expression "carbon felts" are the so-called—graphite felts—which in many instances are predominantly amorphous type carbons which were carbonized to convert only part of the carbon to graphite. In any event, the porous, high surface area carbonaceous cathodes of the present invention are intended to include these so called "graphite" materials. For larger electrode configurations, these high surface area felts, cloths and reticulated vitreous carbons may be bonded for example, by means of suitable conductive epoxy to inert more conductive current carriers such as graphite, Ebonex, or Ti to improve the current density distribution by making the current density more uniform over the entire available electrode surface.

Solid polymer electrolyte technology can be employed in these electrolyses to advantage. Here, the anode side of a suitable cation-exchange membrane, eg Nafion$^R$117, manufactured by DuPont, U.S.A. is coated with a layer of Pt or Au, for example by electroless deposition , and then an anode screen of Pt on Ti is mechanically pressed against this deposited layer. The anolyte feed is then water without any additional conductive ions since the polymeric ionomeric membrane itself provides the ionic conductivity required for electrolysis. Use of solid polymer electrolyte technology has other advantages in terms of lower cell voltage and simpler cell design.

The electrolysis of disulfide substrates should be preferably conducted at lower temperatures, usually −10° to +50° C. to avoid racemization of optically active substrates and products as well as other undesirable reactions, but may be conducted at higher temperatures, even up to near the boiling of the nitrogenous solution if racemization or side-reaction is not a concern and there is little or no opportunity for other undesirable reactions such as polymerization or decomposition occuring. Since reoxidation of the sulfhydryl product to the disulfide form can occur in presence of oxygen or air, especially in alkaline media, electrolyses are generally conducted under an inert atmosphere, usually nitrogen.

The electrolysis cell design should provide for adequate turbulent circulation of the nitrogenous electrolyte solution containing the disulfide substrate to minimize mass transfer limitations. Plate-and-frame cells such as those manufactured by ElectroCell Systems AB (Sweden) are suitable for this purpose, and are sufficiently flexible in design to permit use of solid electrodes, particulate bed electrodes, and other porous electrodes such as carbonaeous felts and cloths, as well as reticulated vitreous carbon. Other suitable cell designs are possible including cylindrical configurations, and packed or fluidized bed electrolyzers. Suitable cell designs including monopolar and bipolar designs are described in various texts, for example *Industrial Electrochemistry*, by D. Pletcher, published by Chapman and Hall, 1982.

Electrolysis may be conducted to 80 to 150% of the theoretical number of coulombs required for conversion of disulfides to sulfhydryl products, but more preferably 100 to 110% of theoretical to ensure high conversions yet minimize hydrogen evolution. The cathode current density for these electrolyses is usually in the range of 50 to 500mA/cm2, with the higher effective cathode current densities being more appropriate near the outset of electrolysis and diminishing in value as the electrolysis proceeds toward complete conversion. An advantage of the above mentioned high surface area carbonaceous cathodes is that higher effective current densities may be maintained throughout the electrolysis of at least 50mA/cm$^2$, and more preferably from 75 to about 250mA/cm$^2$ without significant deterioration in current efficiency, until almost all of the disulfide substrate has been converted.

Upon completion of the electrolysis the desired product is isolated, usually by removal of the nitrogenous solvent by distillation or evaporation under reduced pressure. For cysteine, this solid product can be used as is for a number of applications since it can be as high as 98% or better in purity, but may be further easily purified mainly of cystine, by taking the product up in cold water sufficient to dissolve most of the initial product and filtering off the undissolved cystine and any insoluble material. Recovered cystine can be recycled and employed as feedstock. The filtrate is then evaporated to obtain cysteine with a purity of up to 99.5% or more. Alternatively, purification may be effected by crystallization from cold water, or water-alcohol.

If desired, the amino acid free-base may be converted to an inorganic salt by conventional means. The hydrochloride, sulfate and phosphate salts are representative examples.

The following specific examples demonstrate various aspects of the invention, however, it is to be understood that these examples are for illustrative purposes only and do not purport to be wholly definitive as to conditions and scope.

EXAMPLE 1

A two compartment electrochemical flow cell system was employed using an ElectroCell Systems AB (Sweden) MP Flow Cell, reservoirs for anolyte and catholyte solutions, magnetic drive pumps, Sorensen Model-DCR-45B Power Supply, and ESC Model 640 digital coulometer. The MP Flow Cell was constructed of polypropylene frames, EPDM gaskets, anode ($100cm^2$) of titanium with a Pt/Ir coating, various cathode materials, and a DuPont Nafion 423 cation exchange membrane. Catholyte and anolyte volumes were initially about 1 liter, with the catholyte containing 0.42M l-cystine in 30% aqueous ammonia solution, and the anolyte 3M aqueous sulfuric acid solution. The catholyte solution was circulated at a rate of 4.7 liters/minute and the temperature was maintained below 40° C. while kept under a nitrogen gas blanket to prevent air oxidation. Table 1 compares results for electrochemical reduction of l-cystine at silver, graphite and carbon felt cathodes. The carbon felt cathode was constructed by bonding carbon felt ($100cm^2$), Electrosynthesis Co. Inc. Cat. No. GF-S6 to a graphite plate, by means of graphite-filled epoxy resin. The cathode current density was maintained at $60mA/cm^2$ throughout the experiment, with electrolysis conducted to the extent of 100% of the theoretical charge passed required to convert l-cystine to l-cysteine. After electrolysis, the ammonia solvent was evaporated off to dryness and the product analyzed iodometrically.

TABLE 1

Flow Cell Experiments At Various Cathode Materials

| Experiment | Cathode Material | Cell Voltage Volts | Yield*(%) |
|---|---|---|---|
| 1 | Silver Plate | 4.2–6.1 | 75.6 |
| 2 | Graphite Plate | 4.4–6.0 | 82.8 |
| 3 | Carbon Felt | 4.4–4.8 | 96.6 |

*The yield and current efficiency are the same here.

The yields shown in Table 1 demonstrate that high surface area carbon felt is superior to low surface area silver or graphite plate cathodes in reducing the disulfide linkage.

EXAMPLE 2

The experimental flow cell equipment described in Example 1 was used, containing a carbon felt cathode, with electrolyses conducted over a range of current densities. Table 2 lists the results of electrolysis of l-cystine (0.42M) taken to the theoretical required number of coulombs to form l-cysteine. The anolyte was 3M aqueous $H_2SO_4$, except as noted.

TABLE 2

ELECTROLYSIS OF L-CYSTINE AT CARBON FELT IN AMMONIA SOLUTION

| Expt | Current Density $mA/cm^2$ | Cell Voltage Volts | Yield % At 100% Theory** |
|---|---|---|---|
| 3 | 60 | 4.4–4.8 | 96.6 |
| 4 | 100 | 5.2–6.5 | 99.2 |
| 5* | 100 | 6.2–8.4 | 95.6 |
| 6 | 150 | 6.4–7.8 | 96.5 |
| 7 | 200 | 6.6–9.8 | 90.6 |

TABLE 2-continued

ELECTROLYSIS OF L-CYSTINE AT CARBON FELT IN AMMONIA SOLUTION

| Expt | Current Density $mA/cm^2$ | Cell Voltage Volts | Yield % At 100% Theory** |
|---|---|---|---|
| 8 | 250 | 6.2–8.4 | 94.6 |

*The anolyte was 1M aqueous $(NH_4)_2SO_4$
**The yield and current efficiencies are the same here.

Table 2 demonstrates that carbon felt cathodes can be used very effectively to reduce the disulfide linkage in yields in excess of 90% even at considerably higher, more practical current densities of operation than heretofore reported.

EXAMPLE 3

To exemplify the relative simplicity of product isolation and purification using nitrogenous catholyte solutions, the product of electrolysis experiment #3 of Example 1, was worked up. The crude product, after ammonia evaporation, was dissolved in 750ml of distilled water, the mixture filtered, and the solids washed with a little cold distilled water. The filtrate was evaporated to dryness in vacuo at 40° C. leaving the purified material. Iodometric analysis showed this material was 99.6% l-cysteine by weight. The specific rotation of a sample of 5.02g in 100ml of 1M aqueous HCl was +6.255, which corresponds to an assay for l-cysteine of 99.4%. Elemental analysis %: (observed) C, 29.69;H, 5.84;N, 11.51;S, 26.41; (calculated) C, 29.74;H, 5.82;N, 11.56;S, 26.46.

EXAMPLE 4

L-Cysteine free base was prepared in a manner closely following the method outlined in Japanese Patent application No. 58-23450 (Hasaka) using aqueous $NH_4OH$ containing $(NH_4)_2CO_3$.

The two compartments were separated by a cation exchange membrane (Nafion ® 324). The cathode was a lead sheet. After electrolysis the catholyte was evaporated to dryness and the product dried under vacuum. The product was 89.1% l-cysteine by weight and was found to contain 43ppm lead, as shown by atomic adsorption analysis. For many applications, especially in food and pharmaceutical uses this high lead level would be unacceptable in the product.

While the invention has been described in conjunction with specific examples thereof, this is illustrative only. Accordingly, many alternatives, modifications and variations will be apparent to persons skilled in the art in light of the foregoing description, and it is therefore intended to embrace all such alternatives, modifications and variations as to fall within the spirit and broad scope of the appended claims.

We claim:

1. A high yield method for the electrochemical preparation of amino acid free-bases, which comprises the steps of providing an electrochemical cell having an anode and a high surface area cathode; introducing a basic nitrogenous electrolyte solution into said cell, said solution comprising a disulfide compound; impressing a voltage across said anode and cathode sufficient to reduce the disulfide compound at the cathode; and removing the basic nitrogenous electrolyte solution to yield the amino acid free-base, the concentration of said disulfide compound in the electrolyte solution and the surface area of said cathode being sufficient to provide a cathode current density of at least 50mA/cm$^2$ and a product yield and current efficiency of at least 90 percent.

2. The method of claim 1 wherein the high surface area cathode is a noncontaminating cathode.

3. The method of claim 2 wherein the amino acid free-base is a compound of the formula:

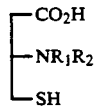

and the disulfide is a compound of the formula:

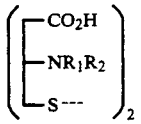

in which $R_1$ and $R_2$ are hydrogen, lower aliphatic, aryl, aralkyl, or wherein $R_1$ abd $R_2$ together are a nitrogen heterocyclic ring of 3 to about 7 atoms in which the nitrogen is basic.

4. The method of claim 3 wherein the high surface area cathode comprises carbon felt or carbon cloth.

5. The method of claim 3 wherein the high surface area cathode comprises a carbonaceous material.

6. The method of claim 4 wherein the electrochemical cell includes an ion-exchange membrane.

7. The method of claim 6 wherein the disulfide compound is cystine, the amino acid free-base is cysteine and the basic nitrogenous electrolyte solution is aqueous ammonia or anhydrous liquid ammonia.

8. The method of claim 7 wherein the basic nitrogenous electrolyte solution includes a volatile organic cosolvent.

9. The method of claim 8 wherein the starting concentration of the disulfide compound in the basic nitrogenous electrolyte solution is at least 0.1 molar.

10. The method of claim 6 wherein the electrochemical cell includes solid polymer electrolyte.

11. The method of claim 1 wherein preparation of the amino acid free-bases is conducted in an undivided electrochemical cell having an anode comprising $Ti_4O_7$.

12. In a method for the electrochemical preparation of cysteine free-base in which cysteine is reduced in an electrochemical cell having an anode and a cathode by the steps of introducing a basic nitrogenous electrolyte solution into said electrochemical cell comprising cystine; impressing a voltage across said anode and cathode sufficient to reduce the cystine at the cathode; and removing said basic nitrogenous electrolyte solution to yield cysteine as the free-base, the improvement comprising conducting the reaction in an electrochemical cell comprising a high surface area, noncontaminating cathode, said cathode having sufficient surface area to provide a cathode current density of at least 50mA/cm$^2$ and a product yield and current efficiency of at least 90 percent.

13. The method of claim 12 wherein the step of removing the basic nitrogenous electrolyte solution is performed by evaporation or distillation.

14. The method of claim 12 wherein preparation of the amino acid free-bases is conducted in an undivided electrochemical cell having an anode comprising $Ti_4O_7$.

15. The method of claim 12 wherein the high surface area cathode comprises a carbonaceous material selected from the group consisting of carbon felt, carbon cloth, specifically fluorinated carbon and reticulated vitreous carbon.

16. The method of claim 15 wherein the electrochemical cell is equipped with an ion-exchange membrane.

17. The method of claim 16 wherein the basic nitrogenous electrolyte solution is aqueous ammonia, anhydrous liquid ammonia, aqueous amine solution or mixture thereof.

18. The method of claim 17 including the steps of purifying the cysteine free-base material by mixing with water, removing any insoluble residue from the aqueous mixture including unreacted cystine, and recovering the purified cysteine free-base material by removing the water.

19. The method of claim 18 including the step of converting the cysteine free-base material to a salt of an inorganic acid.

* * * * *